US008894504B1

(12) United States Patent
Keisler

(10) Patent No.: US 8,894,504 B1
(45) Date of Patent: Nov. 25, 2014

(54) GOLF PUTTING TRAINING DEVICE

(71) Applicant: Stacy Keisler, Tampa, FL (US)

(72) Inventor: Stacy Keisler, Tampa, FL (US)

( * ) Notice: Subject to any disclaimer, the term of this patent is extended or adjusted under 35 U.S.C. 154(b) by 113 days.

(21) Appl. No.: 13/743,219

(22) Filed: Jan. 16, 2013

(51) Int. Cl.
*A63B 53/16* (2006.01)
*A63B 57/00* (2006.01)

(52) U.S. Cl.
CPC ..... *A63B 57/00* (2013.01)
USPC ..... 473/265

(58) Field of Classification Search
USPC ..... 473/265
See application file for complete search history.

(56) References Cited

U.S. PATENT DOCUMENTS

| | | | | | |
|---|---|---|---|---|---|
| 2,987,319 | A * | 6/1961 | Mackenzie | 473/185 |
| 3,275,325 | A * | 9/1966 | Mackenzie | 473/184 |
| 3,434,720 | A * | 3/1969 | Hall | 473/185 |
| 3,434,721 | A * | 3/1969 | Travers | 473/185 |
| 3,561,765 | A * | 2/1971 | Dixon et al. | 473/184 |
| 3,700,243 | A * | 10/1972 | Kenney | 473/180 |
| 4,171,812 | A * | 10/1979 | Marsin | 473/166 |
| 4,323,246 | A * | 4/1982 | Nehrbas, Jr. | 473/236 |
| 4,437,669 | A * | 3/1984 | Pelz | 473/265 |
| 4,823,174 | A * | 4/1989 | Itoh et al. | 257/198 |
| 5,082,280 | A * | 1/1992 | Wang | 473/181 |
| 5,125,564 | A * | 6/1992 | Capy | 229/87.03 |
| 5,129,653 | A * | 7/1992 | Morris et al. | 473/184 |
| 5,135,229 | A * | 8/1992 | Archer | 473/236 |
| 5,150,904 | A * | 9/1992 | Sindelar | 473/251 |
| 5,246,233 | A * | 9/1993 | Sheltman et al. | 473/265 |
| 5,435,547 | A * | 7/1995 | Lee | 473/225 |
| 5,551,695 | A * | 9/1996 | Wolk | 473/236 |
| 5,595,543 | A * | 1/1997 | Wolk | 473/162 |
| 6,179,722 | B1 * | 1/2001 | Bond | 473/180 |
| 6,746,339 | B1 * | 6/2004 | Thibaudeau | 473/268 |
| 6,805,638 | B2 * | 10/2004 | Chang | 473/160 |
| 6,929,561 | B2 * | 8/2005 | Chang | 473/257 |
| 7,074,134 | B2 * | 7/2006 | Piche | 473/265 |
| 7,708,658 | B2 * | 5/2010 | McInerney | 473/407 |
| 8,435,131 | B1 * | 5/2013 | Carter | 473/265 |
| 8,529,364 | B1 * | 9/2013 | De Anda | 473/220 |
| 2007/0249428 | A1 * | 10/2007 | Pendleton et al. | 473/223 |
| 2012/0021845 | A1 * | 1/2012 | Slavik | 473/160 |

* cited by examiner

*Primary Examiner* — Kurt Fernstrom
*Assistant Examiner* — Dolores Collins
(74) *Attorney, Agent, or Firm* — Gulf Coast Intellectual Property Group

(57) ABSTRACT

A golf putting training device operable to provide feedback and training to a user in as to develop a putting stroke having an optimal golf ball speed for a putt. The golf putting training device includes a first longitudinal member and a second longitudinal member that are substantially parallel in manner forming a putting lane therebetween. A ball resistance member is mounted intermediate the first longitudinal member and the second longitudinal member proximate an end. The ball resistance member is operable to inhibit a golf ball traveling at less than three revolutions per second at point of impact with the ball resistance member from traversing across the ball resistance member. A plurality of measurement indicia is uniformly distributed along the first longitudinal member and the second longitudinal member.

20 Claims, 2 Drawing Sheets

GOLF PUTTING TRAINING DEVICE

PRIORITY UNDER 35 USC SECTION 119(E) & 37 CFR SECTION 1.78

This nonprovisional application claims priority based upon the following prior U.S. Provisional Patent Application entitled: Golf Putting Training Device, Application No. 61/590,302, filed Jan. 24, 2012, in the name of Stacy Keisler, which is hereby incorporated by reference for all purposes.

FIELD OF THE INVENTION

The present invention relates generally to golf training equipment, more specifically but not by way of limitation, a golf putting training device that is operable to assist a player improve their putting skills that includes structural members for teaching ball speed control and proper club face alignment.

BACKGROUND

Millions of individuals enjoy playing the game of golf. Those that participate in the game regularly often will practice using a variety of training aids in order to improve their skills. Various types of training aids are available and are typically produced and utilized to improve a particular aspect of the player's game such as but not limited to the proper grip, swing stance and/or putting. These devices are used for self-improvement either with the assistance of a professional coach or by the player themselves. One of the most important areas of the game of golf is putting.

In conjunction with the line of the putt, the speed of the putt is the most critical factor in completing a successful putt. As is known to those skilled in the art, an optimal putt will have a speed that will allow the ball to travel approximately seventeen inches beyond the hole if the ball does not enter the hole. In the physics of golf ball to hole interaction, a golf ball that is revolving at two revolutions per second is a appropriate speed to maximize ball capture on most golf greens. A summary of golf ball speeds and its interaction with the hole are as follows. A golf ball traveling at one revolution per second will have sufficient momentum to proceed over the lip of the hole and be deposited into hole proximate the entry point. A golf ball revolving at two revolutions per second will proceed over the lip of the hole and travel proximate the center of the hole. A golf ball revolving at three revolutions per second will proceed over the lip of the hole and enter the hole distal to the entry point, i.e. the back of the hole. A golf ball revolving at four revolutions per second will proceed over the lip of the hole and impact the opposing wall of the hole. A golf ball speed of three to four revolutions per second proximate the hole is the ideal speed to ensure successful completion of a golf putt.

While numerous putting training aids are available, current existing technology in the field has failed to assist the player in developing proper ball speed. Most players routinely misgauge the speed required to successfully complete a putt from various distances. It is very common for a player swing a putter so as to produce either not enough ball speed and subsequently be short of the hole or the opposite wherein the player will swing a putter and produce too much ball speed and roll the golf ball significantly past the hole.

Another issue with currently available putting training devices is their inability to assist a player in developing the skill required to visualize a proper putting line and simultaneously maintain a square putter blade. In order to successfully complete a higher percentage of putts, the player must be able to visualize the proper line for the golf ball and maintain a square putter blade with respect to the intended path of the golf ball. This skill is necessary in order to successfully complete a high percentage of putts.

Accordingly, there is a need for a golf putting training device that is operable to train a player to develop the correct ball speed so as to improve their distance control and additionally provide visual feedback in order to improve the ability to maintain a square putter blade during the putting stroke.

FIELD OF THE INVENTION

It is the object of the present invention to provide a golf putting training device operable to improve a players ball speed and distance control that includes a first longitudinal member and a second longitudinal member placed on the ground generally parallel with respect to each other.

Another object of the present invention is to provide a golf putting training device wherein the first longitudinal member and the second longitudinal member are manufactured in a plurality of releasably secured sections.

A further object of the present invention is to provide a golf putting training device that is operable to improve a players ball speed and distance control that further includes a ball resistance member.

Yet another object of the present invention is to provide a golf putting training device that improves a players ball speed and distance control wherein the ball resistance member is perpendicularly mounted to the first longitudinal member and second longitudinal member and is intermediate therebetween.

An additional object of the present invention is to provide a golf putting training device that includes at least two embodiments of the ball resistance member.

Still a further object of the present invention is to provide a golf putting training device that is operable to further provide visualization training to a player in order to develop the skill in identifying the proper golf ball path line.

A further object of the present invention is to provide a golf putting training device that is further operable to provide improvement in maintaining a square putter blade throughout the stroke.

Another object of the present invention is to provide a golf putting training device that is operable to improve a players ball speed and distance control wherein one embodiment of the ball resistance member is triangular in shape.

An additional object of the present invention is to provide a golf putting training device that permits golf balls traveling at a speed of approximately three revolutions per second to four revolutions per second to enter the hole adjacent the ball resistance member.

Yet a further object of the present invention is to provide a golf putting training device operable to improve a players ball speed and distance control that is lightweight and portable.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
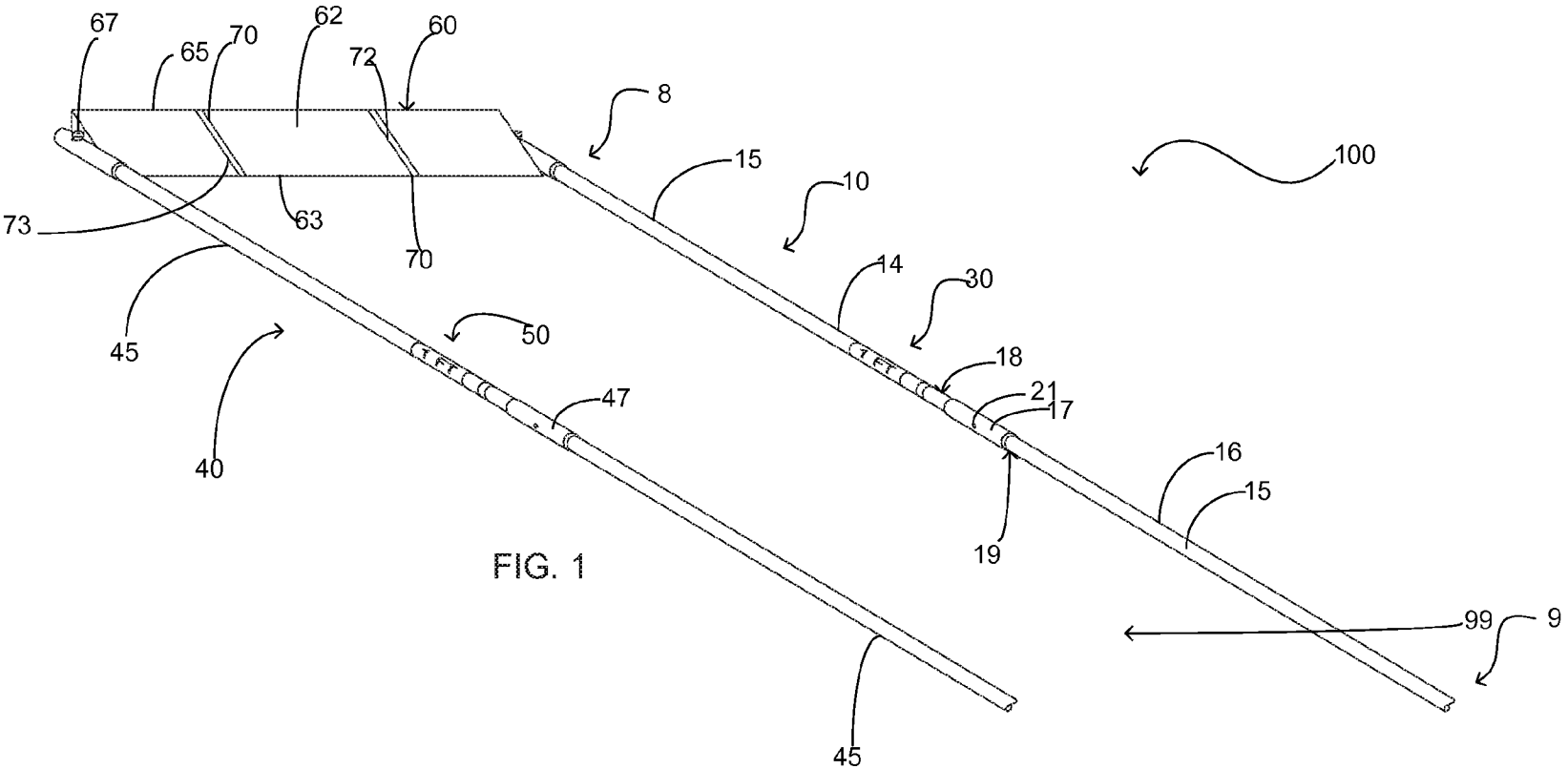
FIG. 1 is a perspective view of the preferred embodiment of the present invention.

Referring now to the drawings submitted herewith, wherein various elements depicted therein are not necessarily drawn to scale and wherein through the views and figures like elements are referenced with identical reference numerals, there is illustrated a golf putting training device 100 constructed according to the principles of the present invention.

Referring in particular to FIG. 1 herein, the golf putting training device 100 includes a first longitudinal member 10 that is generally elongated in manner and rod shaped. The first longitudinal member 10 in manufactured from a suitable durable material such as but not limited to plastic. The first longitudinal member 10 further includes a first end 8 and second end 9. The first longitudinal member 10 is manufactured in a plurality of sections 15 of which two are illustrated herein. Manufacturing the first longitudinal member 10 in sections 15 allows the first longitudinal member 10 to be easily disassembled and transported. Operably coupling the sections 15 is union 17. Union 17 is generally cylindrical in shape and substantially hollow so as to receive ends 18,19 of the first section 14 and second section 16 respectively. Union 17 is manufactured from a suitable durable material such as but not limited to metal. An aperture 21 is bored through the union 17 proximate the midpoint thereof. The aperture 21 functions to receive a device such as but not limited to a golf tee so as to allow a user to releasably secure the golf putting training device 100 to a golf green. It is contemplated within the scope of the present invention that the union 17 could be configured to be completely removable from both first section 14 and second section 16 or be configured to be secured to either end 18 or end 19 permanently utilizing suitable durable techniques such as but not limited to chemical adhesives. While no particular length of the first longitudinal member 10 is required, good results have been achieved with a first longitudinal member 10 that is approximately ten feet in length. Utilizing a first longitudinal member 10 of approximately ten feet provides a sufficient length for a user to practice putts within the range of one to ten feet and develop skills for putting a golf ball at the desired speed as discussed herein.

Disposed along the first longitudinal member 10 are indicia 30. The indicia 30 functions to provide a mark that serves as a measurement location for a user of the golf putting training device 100 to place a golf ball proximate thereto during use of thereof. It is contemplated that the indicia 30 could be marking for units such as but not limited to feet. More specifically but not by way of limitation, the indicia 30 could be located in increments of one feet extending the length of the first longitudinal member 10. It is further contemplated within the scope of the present invention that the indicia 30 could be disposed along the first longitudinal member 10 in numerous different increments and further be operable to display numerous types of marking in addition to and/or in conjunction with length markings.

A second longitudinal member 40 is aligned in a substantially parallel manner with the first longitudinal member 10. The golf putting training device 100 is operable to be superposed a golf green wherein the first longitudinal member 10 and the second longitudinal member 40 are releasably secured to the golf green as described herein having a suitable distance therebetween to accommodate a golf putter blade. The second longitudinal member 40 is constructed similarly to the first longitudinal member 10 as described herein. The second longitudinal member 40 includes a plurality of sections 45 wherein each adjacent section 45 is operably coupled with a union 47 that is constructed similarly to union 17. Indicia 50 similar to indicia 30 is also provided along the second longitudinal member 40 at a location that is generally directly opposing each other, i.e. the indicia 30 is approximately directly across from indicia 50. While no particular length is required for the first longitudinal member 10 and the second longitudinal member 40, good results have been achieved utilizing a first longitudinal member 10 and a second longitudinal member 40 that are approximately ten feet in length.

Still referring to FIG. 1 herein, the golf putting training device 100 further includes a ball resistance member 60. The ball resistance member 60 is operable to be placed adjacent a hole on a golf green. The ball resistance member 60 functions to inhibit a golf ball traveling at a revolution per second that is slower than three revolutions per second from entering a golf hole adjacent thereto. The ball resistance member 60 provides the feedback to a user of the golf putting training device 100 as to whether or not the putt of the user has sufficient speed to be considered a putt of optimal speed. With repetition of practice proximate the indicia 30, 50, a user will develop the necessary skill to produce a putt having the necessary ball speed of 3 to 4 revolutions per second as it impacts the ball resistance member 60 so to traverse the ball resistance member 60 and enter an adjacent golf hole.

The ball resistance member 60 is manufactured from a durable suitable material such as but not limited to metal or plastic. The ball resistance member 60 is triangular in shape, specifically a scalene triangle, having front inclined surface 62 that directionally oriented towards the putting lane 99 intermediate the first longitudinal member 10 and second longitudinal member 40. The front inclined surface 62 has an angle that is operable to inhibit a golf ball traveling at a speed that is less than three revolutions per second when proximate the front edge 63 from proceeding over the rear edge 65 and entering an adjacent golf hole. While no particular angle of the front inclined surface 62 is required, good results have been achieved utilizing a front inclined surface that has an angle within the range of approximately twenty-five to thirty-five degrees. A front inclined surface 62 having an angle of the aforementioned range has been shown to inhibit a ball traveling at less than three revolutions per second at point of impact with the front inclined surface 62 from traversing across the ball resistance member 60. Utilizing the aforementioned angle of the front inclined surface 62 will allow a user to acquire feedback and train with the golf putting device 100 so as to develop an golf ball speed of at least three revolutions per second proximate a golf hole so as to execute a successful golf putt more consistently. Additionally, while no particular length of the front inclined surface is required, good results have been achieved utilizing a front inclined surface that is approximately one and three-quarters of an inch in length. The rear wall 67 of the ball resistance member 60 is perpendicular to the ground and is approximately one inch in length. While no particular width of the ball resistance member 60 is required, good results have been achieved with a width that is approximately eleven inches. It is contemplated within the scope of the present invention that variations in aforementioned dimensions of the ball resistance member 60 could be utilized to produce the desired result as described herein.

Additionally, it is further contemplated within the scope of the present invention that the ball resistance member 60 could be manufactured in numerous different shapes in order to achieve the functionality as described herein.

Disposed on the front inclined surface 62 are alignment indicia 70. The alignment indicia 70 are generally parallel markings produced utilizing suitable techniques and are operable to assist a user of the golf putting training device 100 to visualize a golf hole that is adjacent to the rear wall 67. The alignment indicia 70 are placed such that the parallel markings 72, 73 are four and one quarter of an inch apart which is the width of a conventional golf hole.

Figure 3:
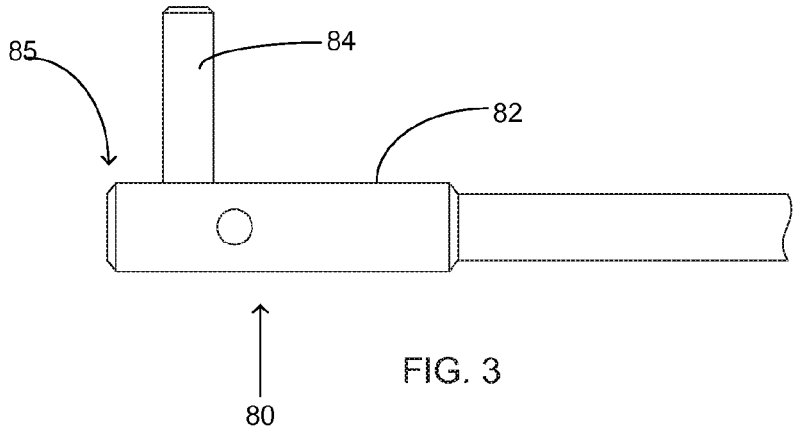
FIG. 3 is a detailed view of the union that operably couples the ball resistance member to a longitudinal member.

Referring in particular to FIG. 3 herein, a detailed view of the end union 80 is provided. The end union 80 is operable to couple the first longitudinal member 10 and second longitudinal member 40 to the ball resistance member 60. The end union 80 includes a generally cylindrical body 82 being manufactured of a suitable durable material such as but not limited to metal. Integrally formed with the body 82 is leg member 84. Leg member 84 is proximate end 85 and is mounted perpendicular in manner to body 82. The leg member 84 is operable to be releasably secured into a hole (not pictured herein) on each side of the ball resistance member 60. An aperture 87 is present and is of suitable size to receive a golf tee therein so as to releasably secure the end union 80 to a golf green.

Figure 2:
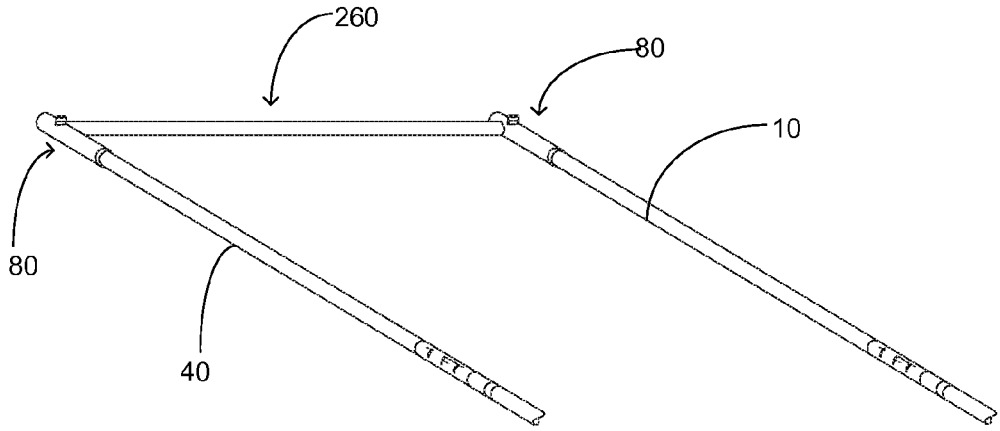
FIG. 2 is a perspective view of an alternative embodiment of the present invention.

Referring in particular to FIG. 2, an alternative embodiment of the ball resistance member 260 is illustrated therein. The ball resistance member 260 is intermediate the first longitudinal member 10 and the second longitudinal member 40 being generally perpendicular therewith. The ball resistance member 260 is elongated and rod shaped being constructed of a suitable durable material such as but not limited to metal. The ball resistance member 260 is constructed having a sufficient diameter so as to inhibit a golf ball traveling at a speed that is less than three revolutions per second at point of impact with the ball resistance member 260 from traversing the ball resistance member 260 and entering an adjacent golf hole. The ball resistance member 260 is utilized in the same manner as described herein for ball resistance member 60 to provide feedback to a user of the golf putting training device 100 so as to develop the skill necessary to produce a golf putt having a desired optimal speed proximate a golf hole on a golf green. It is further contemplated within the scope of the present invention that the ball resistance member 260 and end union 80 are both manufactured from a suitable metal having an operable coupling that further produces two distinct sounds for a ball impacting the ball resistance member 260 at a speed that is less than three revolutions per second and a speed that is equal to or greater than three revolutions per second. This configuration would provide additional audial feedback to a user of the golf putting training device.

Referring in particular to FIG. 1, a description of the operation of the golf putting training device 100 is as follows. In use, a user will superpose the first longitudinal member 10 and second longitudinal member 40 in a parallel manner on a golf green. The ball resistance member 60 is placed adjacent the lip of a hole on the green and is coupled intermediate the first longitudinal member 10 and second longitudinal member 40. Conventional golf tees are inserted into the apertures 21 of unions 17 to secure the golf putting training device to the golf green. A user will then commence repeatedly putting from a position that is adjacent indicia 30 so as to develop the skill necessary to produce a putt with the optimal ball speed proximate the hole. Any putt that is produced by the user having a golf ball speed that is less than three revolutions per second at point of impact with the front edge 63 will be inhibited from traversing over the rear edge 65 and entering the adjacent golf hole.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A golf putting training device comprising:

a frame, said frame being superposed a golf green, said frame including a first longitudinal member and a second longitudinal member, said first longitudinal member and said second longitudinal member being parallel with respect to each other, said first longitudinal member and said second longitudinal member forming a putting lane, said frame having a first end and a second end;

a ball resistance member, said ball resistance member being mounted intermediate said first longitudinal member and said second longitudinal member and being perpendicular therewith, said ball resistance member being positioned at said second end of said frame, said ball resistance member being superposed the golf green, said ball resistance member being positioned adjacent to a perimeter edge of a golf hole located on the golf green, said ball resistance member having an upper edge and a lower edge, said lower edge being proximate the golf green, said upper edge being higher than that of the perimeter edge of the golf hole adjacent to said ball resistance member; and wherein said ball resistance member is constructed to reduce the speed of a golf ball upon impact therewith.

2. The golf putting training device as recited in claim 1, wherein said first longitudinal member and said second longitudinal member further include a plurality of sections, said plurality of sections being releasably secured.

3. The golf putting training device as recited in claim 2, and further including a plurality of unions, said plurality of unions operable to releasably secure said plurality of sections.

4. The golf putting training device as recited in claim 3, wherein said plurality of unions further include an aperture, said aperture being of suitable size to receive a golf tee therein.

5. The golf putting training device as recited in claim 4, wherein said ball resistance member is at least one of the following shapes: triangular or rod shaped.

6. The golf putting training device as recited in claim 5, wherein said first longitudinal member and said second longitudinal member include a plurality of indicia markings thereon, said indicia markings being uniformly distributed on said first longitudinal member and said second longitudinal member.

7. The golf putting training device as recited in claim 6, wherein said ball resistance member is constructed so as to allow a golf ball traveling at a speed at point of impact with said ball resistance member greater than 3 revolutions per second to traverse across said ball resistance member.

8. A golf putting training device operable to be superposed a golf green comprising:

a first longitudinal member, said first longitudinal member being superposed a golf green, said first longitudinal member being rod shaped, said first longitudinal member further including a plurality of sections, said plurality of sections being releasably secured, said first longitudinal member having a first end and a second end;

a second longitudinal member, said second longitudinal member being superposed a golf green, said second longitudinal member being rod shaped, said second longitudinal member further including a plurality of sections, said plurality of sections being releasably secured, said second longitudinal member having a first end and a second end, said second longitudinal member being parallel with said first longitudinal member, said second longitudinal member and said first longitudinal member forming a putting lane;

a ball resistance member, said ball resistance member being positioned adjacent to a perimeter edge of a golf hole on a golf green, said ball resistance member being mounted intermediate said first longitudinal member and said second longitudinal member, said ball resistance member being coupled to said second end of said first longitudinal member and said second end of said second longitudinal member, said ball resistance member being perpendicular in manner to said first longitudinal member and said second longitudinal member, said ball resistance member being triangular in shape having a front inclined surface operable to engage a golf ball, said ball resistance member having a lower edge and an upper edge, said upper edge of said ball resistance member being higher than the perimeter edge of the golf hole; and wherein said front inclined surface of said ball resistance member is operable to reduce the speed of a golf ball upon engaging therewith.

9. The golf putting training device as recited in claim 8, wherein said front inclined surface has an angle within a range of approximately twenty five to thirty five degrees.

10. The golf putting training device as recited in claim 9, and further includin; golf hole alignment markings, said golf hole alignment markings being disposec on said front inclined surface.

11. The golf putting training device as recited in claim 10, wherein the upper edge of said ball resistance member is approximately one inch above the golf green.

12. The golf putting training device as recited in claim 11, and further including a plurality of unions, said plurality of unions operable to releasably id plurality of sections of said first longitudinal member and said ongitudinal member.

13. The golf putting training device as recited in claim 12, wherein said first longitudinal member and said second longitudinal member are approximately ten feet in length.

14. The golf putting training device as recited in claim 13, wherein said first long itudinal member and said second longitudinal member include a plurality of indicia markings thereon, said indicia markings being uniformly distributed on said first longitudinal member and said second longitudinal member intermediate said first end and said second end.

15. A golf putting training device operable to be superposed a golf green and provide training feedback on the ball speed of a putt of a user comprising:

a first longitudinal member, said first longitudinal member being rod shaped, said first longitudinal member being superposed a golf green, said first longitudinal member further including a plurality of sections, said plurality of sections being releasably secured, said first longitudinal member first end and a second end, said first longitudinal member having a measurement indicia uniformly distributed intermediate said first end and said second end;

a second longitudinal member, said second longitudinal member being rod shaped, said second longitudinal member being superposed a golf green, said second longitudinal member further including a plurality of sections, said plurality of sections being releasably secured, said second longitudinal member having a first end and a second end, said second longitudinal member having measurement indicia uniformly distributed intermediate said first end and said second end, said second longitudinal member being parallel with said first longitudinal member, said second longitudinal member and said first longitudinal member forming a putting lane;

a ball resistance member, said ball resistance member being superposed a golf green adjacent to a perimeter edge of a golf hole, said ball resistance being mounted intermediate said first longitudinal member and said second longitudmal member and being perpendicular therewith, said ball resistance member being coupled to said first longitudinal member and said second longitudinal member at said second end of said first longitudinal member and said second longitudinal member, said ball resistance member being a scalene triangle in shape having a front inclined surface operable to engage a golf ball, said ball resistance member having an upper edge and a lower edge, said lower edge being adjacent the golf green, said upper edge of said ball resistance member being above the perimeter edge of the golf hole; and wherein said front inclined surface of said ball resistance member has an angle operable to inhibit a golf ball traveling at less than three revolutions per second at point of impact with said front inclined surface from traversing across said ball resistance member.

16. The golf putting training device as recited in claim 15, wherein said font inclined surface has an angle within a range of approximately twenty five to thirty five degrees.

17. The golf putting training device as recited in claim 16, wherein said ball resistance member is approximately one inch in height.

18. The golf putting training device as recited in claim 17, and further including golf hole alignment markings, said golf hole alignment markings being disposed on said front inclined surface.

19. The golf putting training device as recited in claim 18, and further including a plurality of unions, said plurality of unions operable to releasably secure said plurality of sections of said first longitudinal member and said second longitudinal member, said plurality of unions further including an aperture, said aperture operable to receive a golf tee therein so as to releasably secure the golf putting training device to a golf green.

20. The golf puiting training device as recited in claim 19, wherein said first longitudinal member and said second longitudinal member are approximately ten feet in length.

* * * * *